US005357767A

United States Patent [19]

Roberts

[11] Patent Number: 5,357,767

[45] Date of Patent: Oct. 25, 1994

[54] LOW TEMPERATURE DISPLAY MERCHANDISER

[75] Inventor: Harold L. Roberts, St. Peters, Mo.

[73] Assignee: Hussmann Corporation, Bridgeton, Mo.

[21] Appl. No.: 155,190

[22] Filed: Nov. 22, 1993

Related U.S. Application Data

[63] Continuation-in-part of Ser. No. 60,154, May 7, 1993.

[51] Int. Cl.[5] ..... A47F 3/04

[52] U.S. Cl. ..... 62/256; 454/193

[58] Field of Search ..... 62/256, 524; 454/188, 454/193

[56] References Cited

U.S. PATENT DOCUMENTS

| | | | |
|---|---|---|---|
| 2,157,145 | 5/1939 | Ridge | 62/524 X |
| 2,836,039 | 5/1958 | Weber | 62/256 |
| 3,063,256 | 11/1962 | Lamb | 62/256 |
| 3,130,559 | 4/1964 | Beckwith | 62/256 |
| 3,134,243 | 5/1964 | Hagen et al. | 62/256 |
| 3,139,738 | 7/1964 | Jarvis | 62/256 |
| 3,233,423 | 2/1966 | Beckwith et al. | 62/256 |
| 3,289,432 | 12/1966 | Brennan et al. | 62/256 |
| 3,365,908 | 1/1968 | MacMaster | 62/256 |
| 3,369,375 | 2/1968 | Gerweck et al. | 62/256 |
| 3,392,544 | 7/1968 | Perez | 62/256 |
| 3,850,003 | 11/1974 | Beckwith et al. | 62/82 |
| 3,937,033 | 2/1976 | Beckwith et al. | 62/155 |
| 4,026,121 | 5/1977 | Aokage et al. | 62/151 |
| 4,144,720 | 5/1979 | Subera et al. | 62/256 |
| 4,283,922 | 8/1981 | Subera et al. | 62/256 |
| 4,302,946 | 12/1981 | Ibrahim | 62/82 |
| 4,341,081 | 7/1982 | Ibrahim | 62/82 |
| 5,138,843 | 8/1992 | Tamayama et al. | 62/256 X |

*Primary Examiner*—William E. Tapotcai
*Attorney, Agent, or Firm*—Richard G. Heywood

[57] ABSTRACT

A low temperature food merchandiser having a cabinet with an open front product area, a primary cold air system for maintaining substantially constant frozen food temperatures of 0° F. or ice cream product temperatures of −5° F. in the product area including the formation of a series of vertical curtains of primary low temperature air extending across the open front of discrete product area sections, a secondary air system protecting the primary air curtains, and the primary system also including primary evaporator means constructed and arranged to operate at elevated coil temperatures in the range of −5° F. to −8° F. to maintain 0° F. product temperature or coil temperatures of −12° F. to −15° F. to maintain −5° F. product temperatures, and including high efficiency reverse air cycle defrost means for periodically defrosting the primary cooling means.

26 Claims, 5 Drawing Sheets

LOW TEMPERATURE DISPLAY MERCHANDISER

RELATED APPLICATION

This application is a continuation-in-part application based upon U.S. patent application Ser. No. 08/060,154 filed May 7, 1993.

BACKGROUND OF THE INVENTION

1. Field of the Invention

This invention relates generally to the commercial refrigeration art, and more particularly to improvements in product merchandisers especially designed for the low temperature refrigeration of frozen food products.

2. Description of Prior Art

Since about 1960 the commercial refrigeration industry has developed many food merchandisers having open front product display zones for the display and merchandising of frozen food products. Examples of such prior art configurations utilizing ducted air flow and multiple air curtain control include the following patents:

| U.S. Pat. No. | Date | Inventor |
|---|---|---|
| 2,794,325 | June 4, 1957 | Shearer |
| 2,836,039 | May 27, 1958 | Weber |
| 2,855,762 | Oct. 14, 1958 | Zehnder |
| 2,862,369 | Dec. 2, 1958 | Simons |
| 2,890,573 | June 16, 1959 | Lamb |
| 2,936,596 | May 17, 1960 | Rainwater |
| 2,952,992 | Sept. 20, 1960 | Voorhies |
| 2,962,875 | Dec. 6, 1960 | Barroero |
| 3,010,379 | Nov. 28, 1961 | Arzberger et al |
| 3,063,252 | Nov. 13, 1962 | Lamb |
| 3,063,253 | Nov. 13, 1962 | Dickson et al |
| 3,063,254 | Nov. 13, 1962 | Dickson et al |
| 3,063,255 | Nov. 13, 1962 | Fanick et al |
| 3,094,851 | June 25, 1963 | Beckwith |
| 3,122,892 | Mar. 3, 1964 | Beckwith |
| 3,186,185 | June 1, 1965 | Bently et al |
| 3,218,822 | Nov. 23, 1965 | Bently et al |
| 3,287,929 | Nov. 29, 1966 | Beckwith |
| 3,289,432 | Dec. 6, 1966 | Brennan et al |
| 3,365,908 | Jan. 30, 1968 | MacMaster |
| 3,369,375 | Feb. 20, 1968 | Gerweck et al |
| 3,392,544 | July 16, 1968 | Perez |
| 3,420,070 | Jan. 7, 1969 | Hermanson |
| 3,517,526 | June 30, 1970 | MacMaster et al |
| 3,850,003 | Nov. 26, 1974 | Beckwith et al |
| 4,026,121 | May 31, 1977 | Aokage |
| 4,144,720 | Mar. 20, 1979 | Subera et al |
| 4,265,092 | May 5, 1981 | Abraham |
| 4,302,946 | Dec. 1, 1981 | Ibrahim |
| 4,314,453 | Feb. 9, 1982 | Abraham |
| 4,648,247 | Mar. 10, 1987 | Takazawa et al |
| 4,964,281 | Oct. 23, 1990 | Tanaka |
| 5,048,303 | Sept. 17, 1991 | Campbell et al |
| 5,138,843 | Aug. 18, 1992 | Tamayama et al |

All frozen food merchandisers are designed with the primary objective of maintaining product temperatures in the display area at about 0° F. for frozen food and about −5° F. to −10° F. for ice cream, which in the past has required evaporator coil temperatures in the range of −20° F. down to −35° F. At lower coil temperatures, ice buildup on the evaporator coils is accelerated, and thus the frequency and/or duration time of coil defrosts has been higher with the result that defrost heat usually produces increases in product zone temperatures. Furthermore, the inefficiency of prior art open front frozen food display cases has resulted in high energy consumption requirements. Thus, the large energy costs coupled with the inherent problems of maintaining proper product temperatures for good quality shelf life resulted in a marketing trend to closed, glass front reach-in merchandisers.

SUMMARY OF THE INVENTION

The invention is embodied in a low temperature food merchandiser having a cabinet with an open front product area, a primary cold air system for maintaining substantially constant low target temperatures of at least 0° F. in the product area including the formation of plural primary low temperature air curtains across the open front, a secondary air system protecting the primary air curtains, and the primary system also including primary evaporator cooling means constructed and arranged to operate at elevated coil temperatures in the range of about −8° F. to −12° F. to maintain the 0° F. to −10° F. product area temperatures and including reverse air cycle defrost means for periodically defrosting the primary cooling means.

A principal object of the present invention is to provide a low temperature open front food merchandiser in which optimum product temperatures are maintained with elevated coil operating temperatures and minimum icing conditions.

Another object is to provide an open front merchandiser having a primary low temperature air system having a plurality of discrete shelf display zones protected by the discharge of separate air curtains.

Another object is to provide a multideck, open front, merchandiser having a low temperature refrigeration cycle and a reverse air flow defrost cycle without any appreciable change in product temperature or impact on customer comfort.

Another object is to provide a multideck, open front, low temperature merchandiser that is efficient in operation and affords substantial energy consumption savings in the order of 30% to 40% relative to comparable sized prior merchandisers.

Another object is provide an open front, multideck frozen product merchandiser having a wide range of display shelf flexibility in adjustment or removal.

Another object is to provide a low temperature merchandiser having maximum cooling capacity and product display cube with a narrow footprint occupying minimum floor space in the shopping arena.

Another object is to provide a frozen product merchandiser affording improvements in product display with a variable capacity lower well, individual shelf adjustment and adjustable light modulation.

Another object is to provide a merchandiser with a highly efficient low temperature refrigeration system and primary air distribution network.

These and other objects and advantages will become apparent hereinafter.

DESCRIPTION OF THE DRAWINGS

In the accompanying drawings which form a part of this specification and wherein like numerals refer to like parts wherever they occur.

DESCRIPTION OF THE PREFERRED EMBODIMENT

Figure 1:
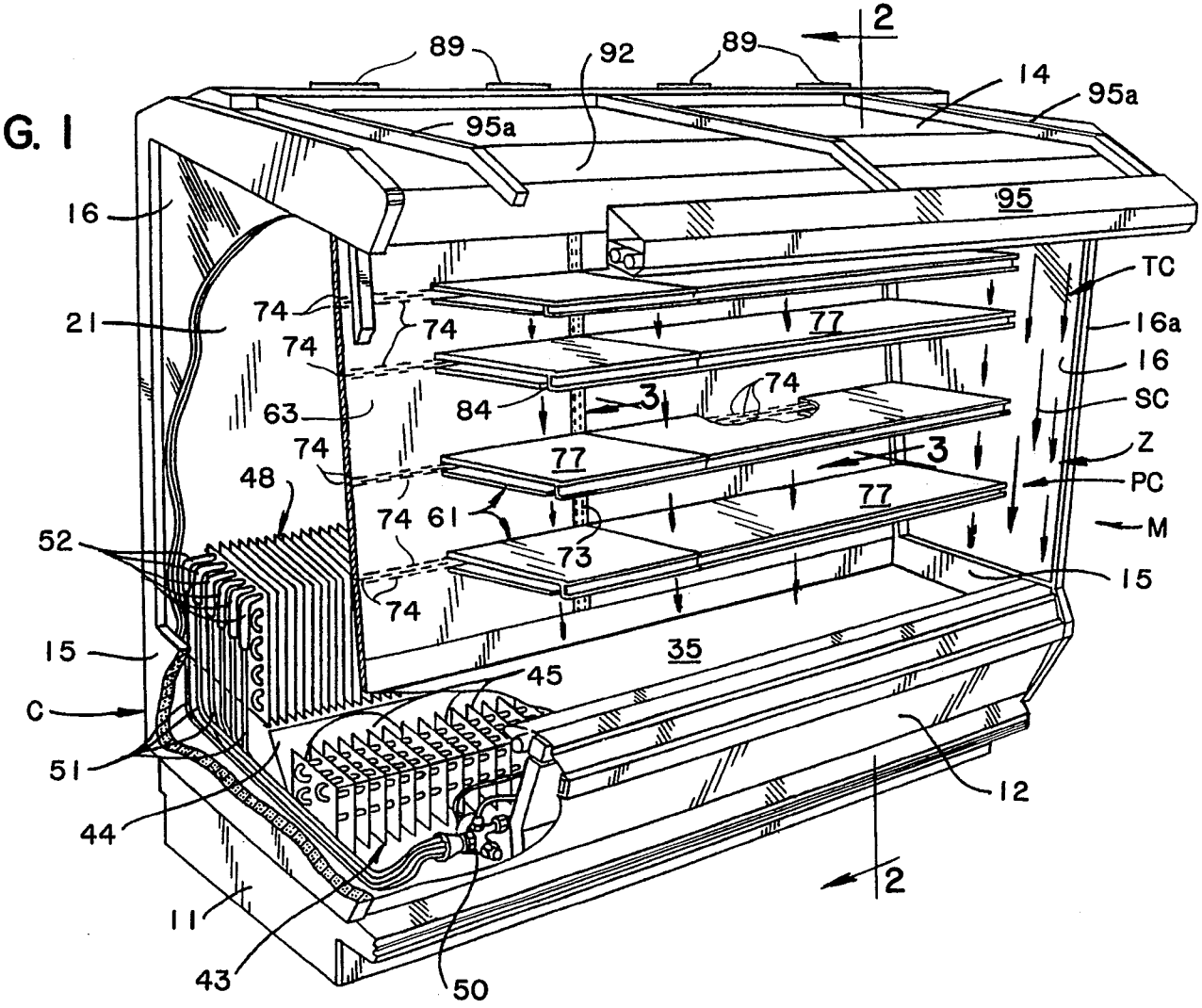
FIG. 1 is a perspective view of an open front, low temperature merchandiser embodying the invention and partly broken away to show a portion of the low temperature primary cooling system.

The present invention constitutes improvements in open front, low temperature, multideck product display merchandisers M having an outer cabinet C with a vertical, open front, product display zone Z cooled to its predetermined low temperature condition by a primary air system P and which is further protected by a secondary air system S and a tertiary air system T. As used herein, "low temperature" has reference to frozen food product temperatures of 0° F. and ice cream product temperatures of at least −5° F., except as may otherwise be specifically described.

Referring now to the drawings, the cabinet C of the merchandiser M of the present invention includes an insulated outer cabinet having a base 11, a low front wall 12, a high rear wall 13, a top wall 14 extending forwardly from the rear wall 13 and end walls 15 including forwardly extending three-pane thermal glass panels 16 with front trim strips 16*a*. The front of the frozen food merchandiser M is open between the top of the front wall 12 and the front of the top wall 14 for direct accessibility to the interior product zone Z of the merchandiser.

Positioned within the outer cabinet and extending longitudinally between the end walls 15 is an intermediate cabinet liner which includes a bottom wall or panel 17 in spaced relation with the base 11 to provide a bottom outer air flue or duct 18, a front or panel wall 19 spaced from the front wall 12 to provide a front flue or return duct 20 in communication with the bottom flue 18 as part of the secondary system S, an insulated rear duct or wall 21 spaced from the back or rear wall 13 to provide a rear duct or flue 22 also in communication with the bottom flue 18, and an insulated top wall or panel 23 spaced below the outer top wall 14 and defining an air distribution chamber 24 of the secondary air system S. The forward end of the top or upper wall 23 has a projecting front member 25 extending away from the top wall 14, and the top wall 14 of the outer cabinet also has a short depending vertical front wall 27 extending downwardly therefrom in forward spaced relation with the front wall member 25 to form a front discharge area or chamber 28 at the front of the chamber 24 of the secondary system S. A relatively wide horizontal section of honeycomb material 29 is constructed and arranged to bridge across or span the front walls 25 and 27 and form the vertical air discharge means through which non-refrigerated air of the secondary system S is discharged, as will be described more fully. The wall 23 slopes upwardly from the rear panel 21, and the rearward portion of the chamber 24 houses a fan 30 or other air circulating means. The chamber 24 is divided in the usual way by a partition 31 extending linearly the length of the cabinet between the rear wall 13 and the top wall 23 and having spaced openings 32 in which the fan blades 33 of plural fans 30 are mounted for efficiently moving air through the entire outer flue network of the secondary system S and in a vertical air curtain SC across the open front of the merchandiser to the return duct 20. It will be seen that the chamber 24 is defined by the forwardly narrowing or converging walls 14 and 23, and that another air control partition or baffle 34 is positioned immediately adjacent to the discharge honeycomb or air straightening means to define a tapering air delivery throat 28 for pressurizing and evening air flow distribution longitudinally and laterally of the honeycomb 29. Thus, the return duct or flue 20, bottom and rear flues 18 and 22, upper chamber 24 and discharge area and member 28, 28*a*, 29 form an air circulatory system for continuously recirculating non-refrigerated air. This secondary system S does not directly cool food products in the display area Z, but forms a protective air wall both during normal refrigeration and defrost cycles of the primary system P. The fans 30 create a negative pressure through the rear, bottom and front flues to draw air curtain air into the front flue 20 and to continuously recirculate the air of the secondary system S in maintaining the secondary air curtain SC discharged downwardly across the merchandiser M.

The merchandiser M also includes an innermost cabinet defining the display area Z in which frozen food products are placed for refrigerated merchandising. The inner cabinet also extends linearly the longitudinal extent between the end walls 15, 16 of the outer cabinet, and includes an insulated bottom panel or wall 35 spaced above the bottom wall 17 of the intermediate cabinet to form a lower or front refrigeration chamber 36. An insulated front panel 37 is spaced from the front wall 19 of the intermediate cabinet and provides a cold air return flue or duct 38 of the primary air system P therebetween, the panel 37 having an angularly-positioned perforated plate 39 secured to the front wall 19 and forming the return inlet for the front flue 38. The inner cabinet also includes a lower rear panel 41 spaced forwardly from the rear wall 21 of the intermediate cabinet and defining a main rear refrigeration chamber 42 therebetween.

The return flue 38 is in communication with the front refrigeration chamber 36, which houses a front evaporator coil section 43 extending the longitudinal length of the merchandiser M. The refrigeration chamber 38 is divided by an angular partition 44 having longitudinally spaced openings 45 for fan blades 46 of fans 47 or like air circulating means. The main rear chamber 42 is in open air flow communication with the front refrigeration chamber 36 and coil 43 through the fan openings 45, and the rear refrigeration chamber 42 houses the full length main evaporator coil section 48 through which primary air is moved by the fans 47. The coil sections 43 and 48 are part of a commercial closed refrigeration system (not shown) that does not form a part of the invention except as to the refrigerant distribution and coil defrost cycles to be described.

Figure 2:
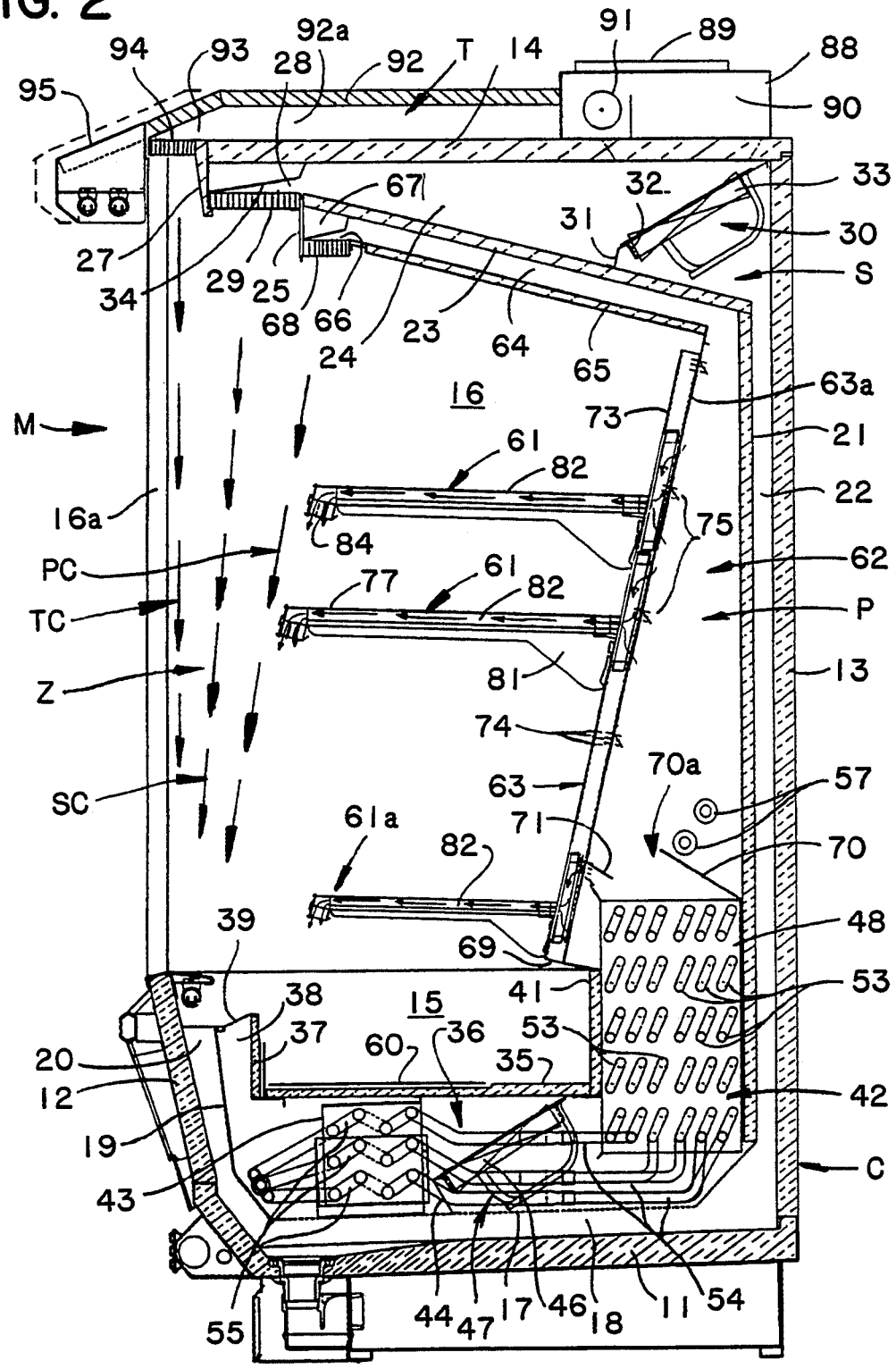
FIG. 2 is a vertical cross-sectional view of the merchandiser as taken substantially along line 2—2 of FIG. 1.
Figure 5:
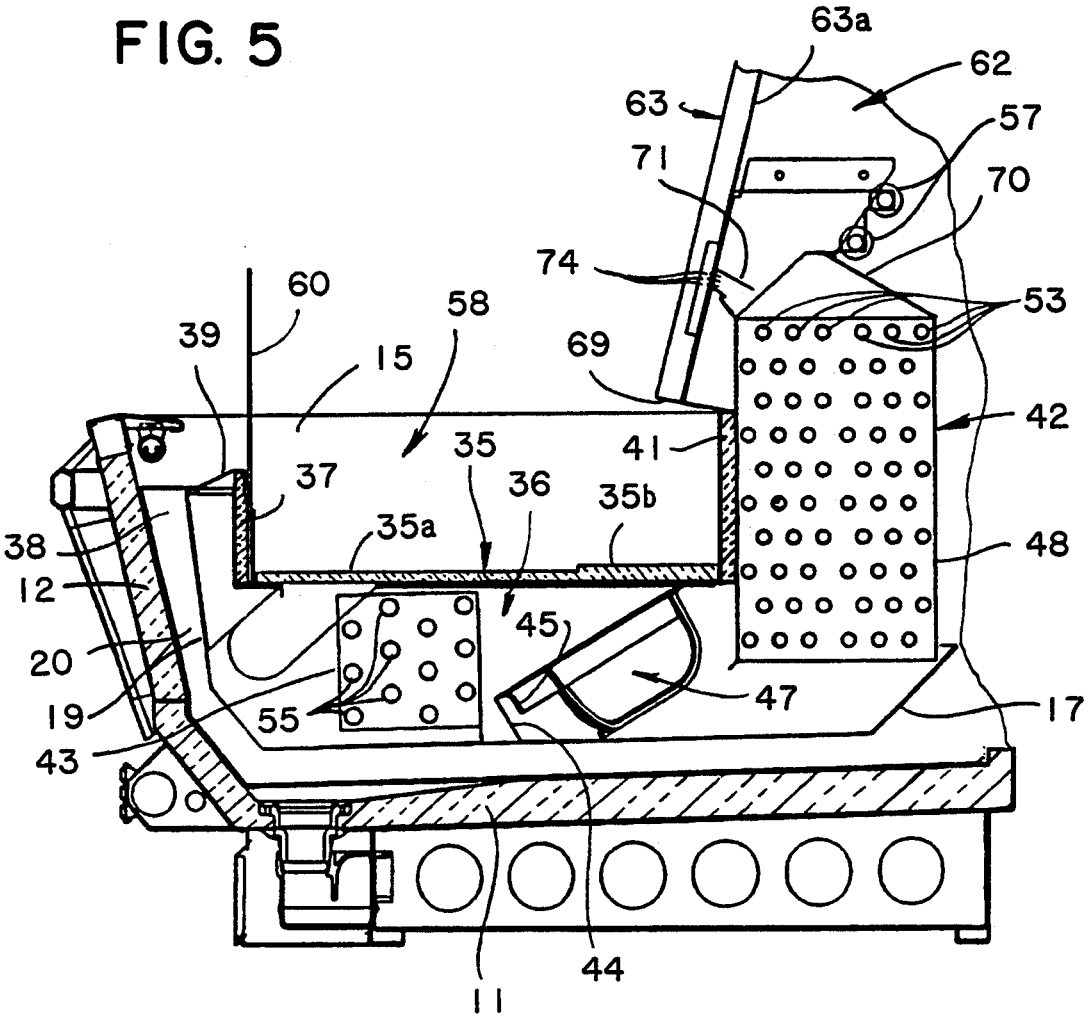
FIG. 5 is a greatly enlarged fragmentary and partially diagrammatic cross-sectional view, similar to FIG. 2, and showing another portion of the primary cooling system, and also illustrating a foldable product zone wall.

Still referring to FIG. 2, it is clearly shown that the front and rear chambers 36 and 42 form an L-shaped main refrigeration chamber positioned at the bottom and rear of the cabinet and having inlet and outlet ends as part of the primary refrigerated air system P with the normal air flow circulation being downwardly in the front flue 38 and across the front coil section 43 and upwardly through the rear coil section 48. As seen in FIGS. 1, 2 and 5, the refrigeration system liquid line (not shown) is brought into the base of the merchandiser cabinet in a conventional way and connects to a conventional thermostatic expansion valve 50 or the like. The expansion valve 50 is piped by six parallel coil runs or circuits 51 of substantially equal length extending across one end of the chambers 36 and 42 and connecting with the upper coil inlet tubes 52 to each of six vertical circuits 53 through the rear main coil 48. Refrigerant flow is first distributed to the upper coil tubing of the rear coil 48 from the expansion valve 50, which thus will be the coldest zone of the main system and which is also the area of primary air discharge upwardly and outwardly of the main coil section 48 for distribution to cool the product zone Z. Refrigerant flow is downwardly in the rear coil 48 in reverse flow to the direction of primary air movement through the coil during the refrigeration cycle. The six separate vertical coil circuits 53 are connected in pairs at the bottom of the rear coil to three horizontal refrigerant circuits 54 which connect to three corresponding coil circuits 55 of the front coil 43, which in turn are connected to a suction line take-off in a usual manner for returning expanded vaporized refrigerant to the refrigeration system compressors (not shown). The conduit size of the six distribution circuits 51 and rear coil tubes 53 is relatively smaller than the conduit size of the three connection circuits 54 and front coil tubes 55 to eliminate pressure drop in the evaporator coils except as typically controlled through the entire circuitry from the expansion valve 50. For instance, the six delivery circuits 51 and rear coil tubing 53 may be sized at $\frac{5}{8}$ inch, and the three connection circuits 54 and front coil tubing 55 may be sized at $\frac{3}{4}$ inch. Thus, the refrigeration cooling means for the primary air system P produces the coldest coil temperatures at the point of primary air discharge from the rear coil section 48, and slightly warmer coil temperatures will prevail at the return air lead-in to the front coil 43. In order to maintain the product area at about 0° F. for frozen foods, the temperature of the primary air exiting the rear coil 48 must be in the range of −2° F. to −5° F., and optimally at about −3° F., which is produced by rear coil temperatures in the range of −5° F. to −8° F. in the present merchandiser. This contrasts with prior coil temperatures of the magnitude of −20° F. to produce −10° F. exit air temperatures in order to achieve and maintain a 0° F. product zone. Similarly, in the case of ice cream, the rear coil operates at about −12° F. to −15° F. to produce exit air temperatures of about −10° F. to −12° F. to maintain the product area target temperature of at least −5° F. which contrasts with prior ice cream merchandisers requiring about −30° F. coil temperatures to produce exit air temperatures of −18° F. to −20° F. It will be clear that the evaporator coils 43 and 48 are of the fin and tube type, and the fin spacing (longitudinally of the merchandiser M) of the front coil 43 is wider than the fin spacing of the rear coil 48 so that the front coil functions primarily as a "frost catcher" to initially precool recirculated air curtain air from the open front of the display area Z and start to remove its moisture content in the form of ice on the fins without bridging across and blocking primary air flow through this coil section. The counterflow refrigerant distribution in the coil sections 48 to 43 (relative to the direction of air flow) results in substantially even ice or frost build up on the fins and more even air distribution longitudinally in the air system channels.

The presently preferred form of defrost of the main refrigeration coils 43 and 48 is by electrical defrost, and a pair of horizontally and longitudinally extending Calrod defrost heaters 57 are disposed vertically above the rear coil 48. A defrost cycle is carried out by reverse air flow operation of the primary fans 47 in the primary system P to bring the heat downwardly through the rear coil 48 then forwardly through the front coil 43. The efficiency of the present merchandiser is designed to reduce the number of defrost cycles (e.g. from 3 to 2) and to shorten each defrost duration from about 40 minutes heretofore to about 20 to 30 minutes while employing about one-half the amount of electric heat previously required for defrosting. Thus, even with larger primary coils, the use of substantially less electric wattage for shorter and less frequent defrost periods contributes to the high efficiency of the present merchandiser. It will be understood that hot gas defrost or latent heat defrost may be employed in lieu of electric heat defrost, as will be readily apparent to those skilled in the art. In the case of gas defrost, the primary air circulation is still reversed and the defrost duration will be about 15 to 20 minutes.

It is now apparent that, in the normal refrigeration cycle, air is drawn into the return flue 38 by the negative pressure developed by the fans 47 and passed through the coils 43, and is then forced upwardly through the rear coils 48 where the air is fully refrigerated to the elevated low exit temperatures of −5° F. to −2° F. required for maintaining food products in frozen condition at 0° F. "Elevated low coil temperature" herein means that the multideck, open front merchandiser M and its primary air refrigeration and circulation system P are constructed and arranged to keep the product zone Z and food products therein at the designated target temperature (of 0° F. for frozen food products or −5° F. for ice cream products) while operating at a temperature of only a few degrees colder—as contrasted with conventional prior merchandisers that generally operate at much lower coil temperatures. It is known that each degree of lower coil temperature results in more moisture removal and icing in the coil which by itself results in lost refrigeration capacity, additional or longer defrosts and high product temperatures above 0° F. In the present invention the main coil size is increased about 25% to 40% in order to achieve more efficient refrigeration and better air control.

The bottom panel 35 and front and rear panels 37 and 41 of the inner cabinet liner and the end walls 15 of the outer cabinet define a lower well 58 of the display area Z in which food products may be placed. As shown best in FIG. 5, the front part **35*a* of the bottom panel 35, extending a substantial distance back from the vertical front panel 37, is thinner than the rearward portion 35*b* to accommodate a movable glass shelf panel 60. This panel 60 is hinged at its longitudinal forward margin for upward swinging movement from a horizontal shelf-forming position in which the panel 60 lies in the recessed thinner area 35*a* of the bottom panel 35 (FIG. 2) and a vertical wall-forming position in which the panel 60 extends upwardly parallel to the front panel 37, but above the lower front wall 12 and lower part of end wall 15 (FIG. 5). In this way the area of the well 58 can be substantially deepened for certain merchandising purposes, and the glass panel affords full visibility. It will be clear that the merchandiser M is of the multideck-type having a plurality of vertically spaced horizontally extending shelves 61 in the upper portion of the product display zone Z, but that the shorter lower shelf 61*a*** normally accommodating access to the shallow well configuration of FIG. 2 is removed in order to raise the shelf panel to its front wall forming position.

The primary air refrigeration and distribution system P is designed to maintain optimum product temperatures with a minimum change from the operating coil temperatures (e.g., a change of about 2° to 5°). Primary air is discharged upwardly in the rear chamber 42 through the main rear coil section 48 and into a rear air distribution flue or duct 62 that is vertically disposed between the intermediate insulated rear wall 21 and a sloping front panel 63, which also forms the rear or back wall of the upper display area Z. The primary air distribution system P has a top flue or duct 64 delineated by an insulated top panel or wall 65, which extends forwardly from the rear duct 62 and terminates at a tapering front discharge chamber 66 defined, in part, by an air control baffle 67 connected between the depending wall 25 and the insulated top wall 23 of the intermediate cabinet to back-pressure primary air and even out its longitudinal distribution for discharge through an air straightening honeycomb 68 or the like to form a primary air curtain PC of low temperature air across the open front of the display area Z.

The lower end 69 of the upper rear panel 63 connects to the upper end of the lower rear panel 41 below the upper air discharge end of the rear coil 48. A primary air control baffle 70 projects angularly from the panel 21 to direct air flow from the coil 48 forwardly as well as upwardly into the wide bottom area of the rear duct 62, and another angular baffle or air deflector 71 connects to the opposed surface of the rear panel wall 63 to project angularly downwardly toward the leading air discharge edge of the coil 48 and substantially parallel with the rear panel baffle 70 to define an air proportioning throat or control means 70*a*.

The upper rear panel 63 is spaced from the rear panel 21 of the intermediate cabinet by suitable means including a center divider wall and shelf support 73 disposed vertically between the end walls 15 and dividing the rear cold air delivery flue or duct 62 into at least two sections. The rear panel 63 is provided with a plural series of air outlet openings or moire 74, and upper series of moire for the upper shelves 61 each have a baffle or air deflector 75 positioned to extend into the rear duct 62 and deflect a portion of the primary air stream through the moire for delivery to the hollow shelves 61 as part of the primary air system P. As shown best in FIGS. 3 and 4, the shelves 61 are adjustably mounted on the rear wall 63 and extend forwardly therefrom into the upper portion of the display area Z. The shelf support stanchions 73 are formed on the center wall divider 73 and at each end of the display area to adjustably support the shelves 61 within a predetermined vertical range defined by the location of the moire 74 and shelf sealing means 76 to be described.

Figure 3:
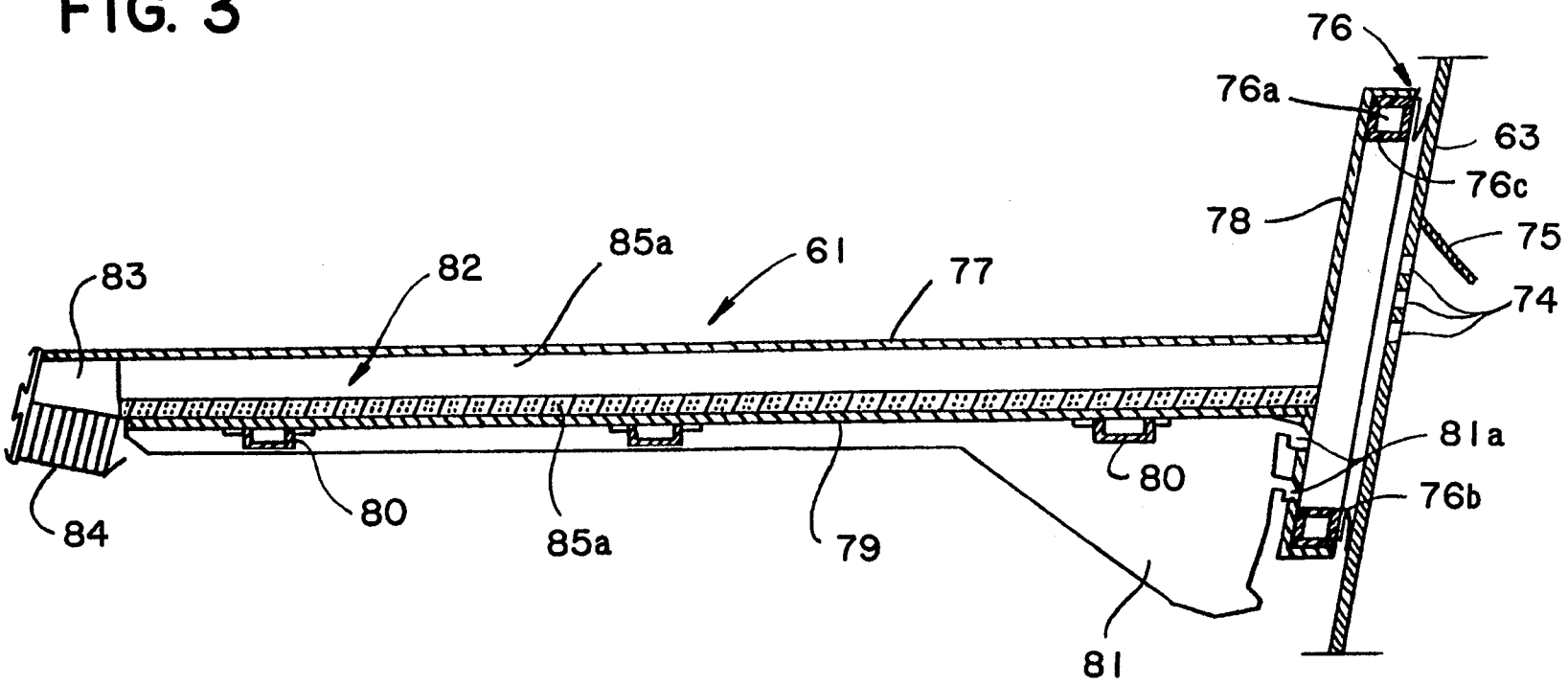
FIG. 3 is a greatly enlarged fragmentary cross-sectional view of a product area shelf forming a portion of the primary air distribution system.

In FIG. 3 it will be seen that each shelf 61 has a horizontal shelf plate or deck 77 with a back plate 78 secured at an angle to accommodate the slope of the rear panel 63. The shelf 61 also has a bottom metal panel 79 in spaced relation with the upper panel 77, and it is reinforced with longitudinal structural hat sections or members 80 to support substantial product weights on the shelf. The usual shelf mounting brackets 81 with bayonet tabs 81*a* are provided for adjustably mounting the shelf 61 on the shelf stanchions 73 at the center and ends of the merchandiser. The space between the upper and lower shelf plates or panels 77 and 79 is constructed and arranged to define an air delivery channel means 82 extending to a longitudinal discharge chamber 83 at the front of each shelf, and longitudinal honeycomb sections 84 are provided for air control from the discharge chamber 83 at each shelf level. However, it is to be understood that selective shelves 61 may be removed from the product zone Z without adversely affecting the operation of the merchandiser or the maintenance of low product temperatures therein.

Figure 4:
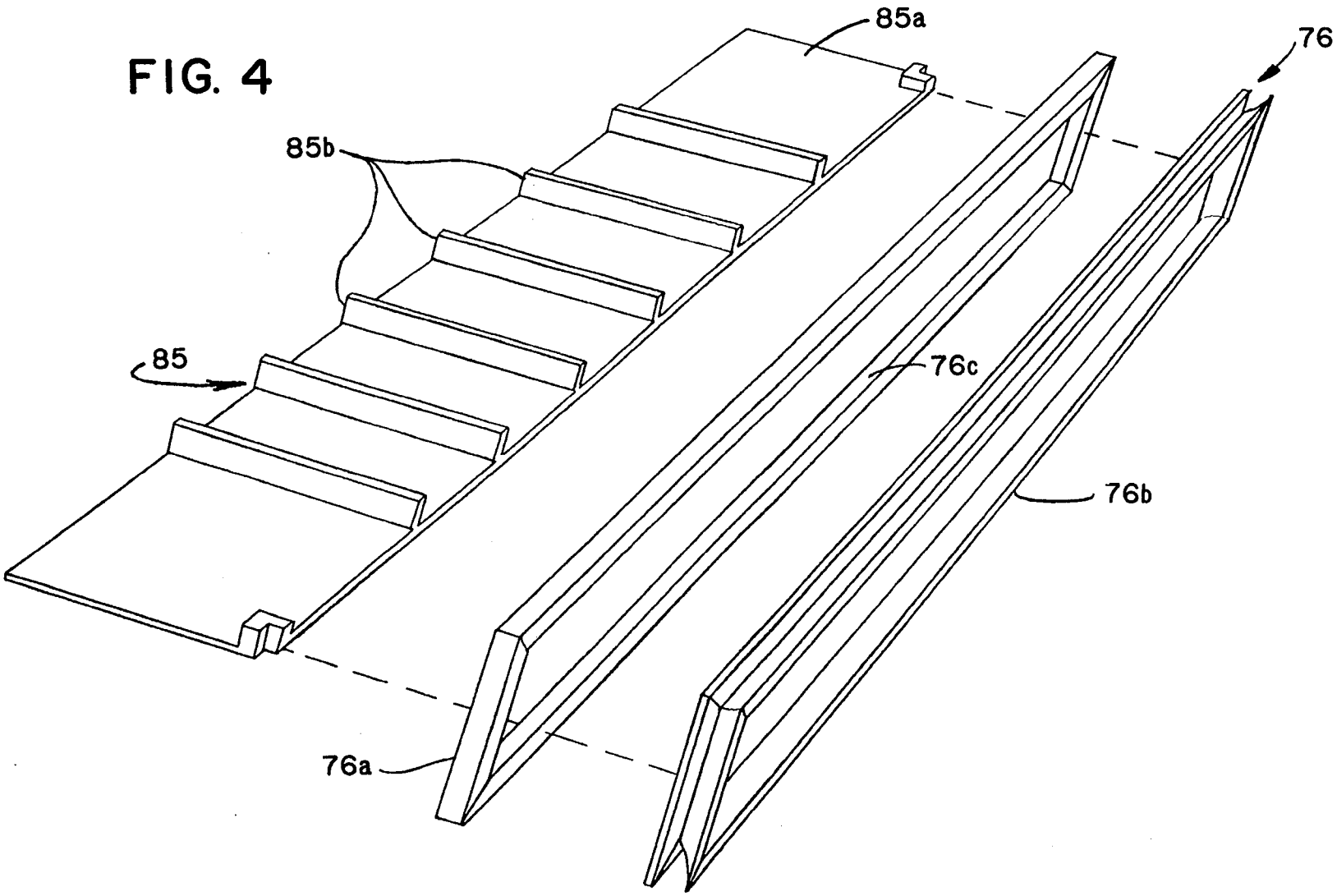
FIG. 4 is an exploded isometric view showing the foam core and seal of the shelf.

The space between the upper and lower shelf panels 77 and 79 accommodates an insulated foam shelf core 85 having a continuous bottom panel 85*a* with longitudinally spaced upstanding ribs 85*b* which extend the depth of the shelf 61 and define the channel or parallel air tunnel means 82 for conveying primary air from the moire inlets 74 to the shelf air discharge honeycomb 84 (see FIGS. 3 and 4). The shelves 61 sealably engage the panel 63 and, for that purpose, the back plate 78 of each shelf has the sealing means 76 attached to provide an air seal framing around the channel means 82. The sealing means 76 include extruded frame pieces or members 76*a* of rectangular cross-section assembled into a rectangular frame attached to the core member 85 or to the back plate 78 itself, and a resilient sealing member 76*b* is attached to or formed integral with the extruded frame pieces 76*a*. The shelf 61 is adjustable vertically within the confines of the air inlet opening or window 76*c* defined by the frame, and the seal member 76*b* is compressed into sealing engagement against the rear panel front surface 63 to maintain primary air flow from the primary rear duct 62 into the shelf tunnels 82 as diverted or proportioned by the baffles 71 and 75 through the moire openings 74. It will be noted that a removable strip of magnetic tape 86, FIG. 5, may be applied to cover the moire section 74 whenever a shelf 61 is removed to prevent primary air leakage into the rear portion of the display zone Z next to the panel 63 although some amount of shelf discharge air will circulate by convection rearwardly over the product on the next lower shelf. It will also be noted that the top deck or plates 77 of the shelves 61 afford conductive cooling of the products placed thereon, but that the lower panel 79 is insulated by the bottom core wall 85*a* to obviate moisture migration and frost buildup under the shelves.

Referring again to FIG. 2, the tertiary air system T is an ambient air system mounted on the exterior of the main outer cabinet C. The tertiary system T includes a longitudinal air moving housing 88 attached to the back of the top wall 14 and having plural filtered air intake openings 89 in communication with a main intake chamber 90, which connects to plural blowers 91 preferably of the tangential type. The rear housing 88 and blower outlet therefrom connect to a forwardly extending air duct wall 92 defining the delivery duct 92*a* for conveying ambient air from the blowers 91 to the front of the merchandiser M. This duct tapers or is baffled to define a narrowing air discharge area 93, and an air control honeycomb 94 through which a tertiary air curtain TC of ambient air is formed across the open front outwardly of the secondary air curtain SC. The merchandiser M is also provided with an upper light canopy 95 that is constructed and arranged to illuminate the product zone Z, and may be telescopically or otherwise adjustable on struts 95*a* to be extended forwardly to modify the lighting effect.

In the operation of the merchandiser M, the primary system P, the secondary system S and the tertiary system T cooperate to provide the desired low temperatures in the display area Z for keeping food products in frozen condition and for providing an inner cold front or wall of low temperature air with a temperature gradient outwardly to ambient that obviates the necessity for doors or glass panels across the front of the merchandiser shelves 61. The glass retaining wall or barrier 60 is only turned up above the low front wall 12 of the outer cabinet as needed to enlarge the well volumetrically. The three air systems also reduce to a minimum the amount of ambient room temperature air that becomes entrained or intermixed with the low temperature air wall PC so that the merchandiser can operate efficiently and perform its function of maintaining low frozen food product temperatures. In addition, moisture is substantially eliminated from the display area Z and condensation, and consequent icing, is substantially reduced on the evaporator coils 43 and 48 of the primary system P.

In the operation of the primary system P, the main fans 47 draw cold air into the return duct 38 from the display area Z and through the front coil section 43, and then pushes this pre-cooled and dehumidified air upwardly through the large rear coil 48 in chamber 42 where the temperature of the air is reduced to the requisite optimum temperature, e.g. −3° F. for frozen food. The primary air stream forced through the coil 48 is diverted by rear flue baffle 70 and the major portion of the air passed upward in rear delivery duct 62. A small portion of the coil air is deflected downwardly by baffle 71 into the lower shelf duct 82 and other portions of air are diverted at each shelf level with the final air portion flowing forwardly and upwardly in upper duct 64 to the primary honeycomb 68. It will be seen that the rear duct 62 forms a long upward channel with converging walls 21 and 63. The volume of air flow proportioned into each shelf duct 82 is substantially uniform and about one-half of the volume of air flow delivered through the top duct 64 for downward discharge through the primary honeyconch 68 to form the low temperature air curtain PC. Thus, primary air is discharged at the front top 68 of the display area and at the front only of each shelf 61 to provide convection cooling of the display area of the next lower shelf without distribution of any air from the rear or intermediate shelf location, whereby by discharging the same temperature air at multiple vertical levels from top to bottom in the display zone, the temperature will be kept substantially constant throughout.

The main or primary system fans 47 create a negative suction or return air velocity of about 600 fpm, and this air velocity is reduced at the rear discharge duct control throat **70*a* to about 300 fpm which is maintained during vertical air distribution by the tapering rear duct configuration. The air velocity of the primary air is reduced as it translates laterally at the deflectors 71, 75 through the respective moire and transverses the shelves 61 to the discharge honeycombs 84 thereof. This reduction in air velocity may also result in an air speed gradient at the respective shelf levels from bottom to top with the discharge at the lower shelf 61*a* being about 250 fpm and the successively higher shelves having successively lower air speeds up to an upper shelf air discharge 84 of about 175 fpm. The first primary air curtain PC is discharged from the main system honeycomb 68 with a reverse taper or air speed gradient from its back face to its front face of about 200 fpm to 250 fpm established by the air control baffle 67**. The lower speed or reduction in velocity established at the back or rearward face of the air curtain PC accommodates merger with the upper shelf discharge air and then each successively lower shelf-to-shelf air curtain with minimum turbulence at the interfaces of the curtains to enhance the cooling at the discrete shelf zones by the respective associated curtains.

The secondary system S has a discharge honeycomb of about twice the width as the primary system discharge 68 to provide a wide non-refrigerated air curtain SC, and the curtain SC also preferably has a reverse taper or air speed gradient with a rear face velocity of about 250 fpm and a front or outer face of about 300 fpm. The tertiary system T discharges a narrower width curtain TC similar to the primary air curtain PC and with a box profile of about 300 fpm. Thus, the air speeds at the interface of the adjacent curtains will be about the same to reduce intermixing and turbulence. In the preferred embodiment disclosed, the ratio of the shelf air curtains to the primary curtain PC to the secondary system curtain SC to the tertiary curtain will be about 1:2:4:2. The curtain discharged at each successive shelf front contributes to the formation of widening primary curtain PC. The return air temperature of the primary system P at the return duct 38 will be substantially lower than prior art merchandisers.

During defrost, the normal refrigeration cycle of the primary system coils 48 and 43 is discontinued and the defrost means (e.g., electric or gas) is initiated along with a reversal of the primary fan direction to draw heated defrost air downwardly (from the Calrod heaters 57) through the rear and front coil sections 48 and 43 and upwardly in the front duct 38. This practice is well-known in the art. However, the secondary air system S and tertiary system T continue to function in their normal downward curtain formation to shield the product zone Z and to create at least a partial short circuit of heated primary air from the return grill 39 back downward into the secondary return flue 20. The defrost parameters are highly efficient and the duration of each defrost cycle has been substantially shortened by about one-half to one-third, e.g., from about 40 minutes to 20 to 30 minutes for electric at about one-half of the wattage required in prior art systems, as previously described.

The present merchandiser is highly efficient in operation and provides a large accessible product display area Z for displaying frozen food products while occupying a minimum floor space. It is to be understood that the foregoing description and accompanying drawing have been given only by way of illustration and example, and that changes and modifications in the present disclosure, which will be readily apparent to all skilled in the art, are contemplated as within the scope of the present invention, which is limited only by the scope of appended claims.

What is claimed is:

1. A refrigerated merchandiser having a cabinet with an open front product display area, primary air system means comprising evaporator means constructed and arranged for refrigerating primary air to elevated low refrigeration temperatures and air moving means for circulating primary air in a first refrigerating direction to maintain a substantially uniform low target temperature throughout the display area, said primary air circulating means forming a first primary air curtain discharged downwardly across the open front of the display area from the top of the merchandiser cabinet, vertically adjustable shelf means in said display area and having an upper product supporting surface, said shelf means being constructed and arranged with air channeling duct means forming a part of the primary air circulating means and discharging at least one additional curtain of primary air downwardly from the front of the shelf means immediately inwardly of the first primary air curtain at the open front of the display area, the air flow of said primary air curtains being the only positive air movement at said display area, at least one other air system means constructed and arranged for forming a secondary air curtain discharged downwardly across the open front of the display area immediately outwardly of said primary air curtains, and defrost means constructed and arranged for periodically defrosting said evaporator means, including means for reversing said air moving means for circulating primary air through the evaporator means in a second reverse air flow defrosting direction while maintaining the normal operation of said other air system means.

2. The merchandiser of claim 1, in which said evaporator means is constructed and arranged to operate at elevated coil temperatures in the range of −5° F. to −8° F. to produce exit air temperatures of said primary air in the range of −2° F. to −5° F. for maintaining the display area target temperature of substantially 0° F. for frozen food products.

3. The merchandiser of claim 1, in which said evaporator means is constructed and arranged to operate at elevated coil temperatures in the range of −12° F. to −15° F. to produce exit air temperatures of said primary air in the range of −10° F. to −12° F. for maintaining the display area target temperature of substantially −5° F. for ice cream products.

4. The merchandiser of claim 1, in which said evaporator means comprises a split evaporator coil having a first main coil section and a second pre-cooler coil section, and said air moving means circulating primary air in said first refrigerating direction sequentially through said pre-cooler and main coil sections, and refrigerant distribution means for feeding said coils counterflow to the first direction of primary air flow therethrough.

5. The merchandiser of claim 4, in which said refrigerant distribution means comprises an expansion valve, a plurality of separate and parallel first coil circuits through said main coil section and connected to the expansion valve, a fewer number of separate and parallel second coil circuits through said pre-cooler coil section and being connected and arranged to receive substantially equal amounts of expanding refrigerant flow from the first coil circuits of the main coil section.

6. The merchandiser of claim 5, in which said main coil section is at least four times larger than the pre-cooler coil section with twice the number of first coil circuits as the second coil circuits, and in which the refrigerant tubing of the first coil circuits is smaller than the refrigerant tubing of the second coil circuits.

7. The merchandiser of claim 1, in which said shelf means comprises a plurality of adjustable shelves discharging a plurality of vertically spaced primary air curtains to respectively cool discrete shelf zones throughout the display area.

8. The merchandiser of claim 7, in which said first primary air curtain is substantially wider than each of said plural curtains of primary air discharged at said shelf means.

9. The merchandiser of claim 8, in which said primary air system includes means for producing a tapering velocity profile of said first air curtain with the air movement at the inner face adjacent to said display zone being at a slower velocity than at the outer face thereof.

10. The merchandiser of claim 9, in which the air velocity at the inner face of the first primary air curtain is about 200 fpm, and the velocity at the outer face is about 250 fpm.

11. The merchandiser of claim 9, including means for producing a velocity gradient of the plurality of air curtains at the front of the shelf means in which the lower shelf means discharges the fastest air curtain and the uppermost shelf means discharges the slowest air curtain.

12. The merchandiser of claim 9, in which said other air system means comprises secondary air circulating means forming said secondary curtain, and means associated therewith for producing a tapering velocity profile of said secondary air curtain with the air movement at the inner face being slower than at the outer face.

13. The merchandiser of claim 12, in which the air velocity at the inner face of the secondary air curtain is about 250 fpm, and the velocity at the outer face is about 300 fpm.

14. The merchandiser of claim 12, in which the air curtain velocity at the inner face of the secondary air curtain is substantially the same as the air velocity at the outer face of the first primary air curtain.

15. The merchandiser of claim 12, in which the secondary air curtain is substantially wider than the first primary air curtain.

16. The merchandiser of claim 14, in which the air curtains of primary air are recirculated into and through the refrigerating and circulating means of said primary air system means, and the other air system means includes means for recirculating the secondary air curtain through a non-refrigerated path within the merchandiser cabinet.

17. The merchandiser of claim 16, which includes a third air system constructed and arranged for forming a third air curtain of ambient air across the open front of the display area outwardly of the secondary air curtain.

18. The merchandiser of claim 17, in which the air curtain velocity at the inner face of the third air curtain is substantially the same as the air velocity at the outer face of the secondary air curtain.

19. The merchandiser of claim 17, in which the third air curtain is substantially narrower than the secondary air curtain.

20. The merchandiser of claim 12, in which the width of each of the plural air curtains of the shelf means to the width of the first primary air curtain to the width of the secondary air curtain is in a ratio of approximately 1:2:4.

21. The merchandiser of claim 19, in which the width of the third air curtain to the width of the secondary air curtain is in a ratio of approximately 2:4.

22. The merchandiser of claim 1, in which said primary and secondary air curtains are maintained in substantially side-by-side parallel air flow relationship during normal refrigerating operations and have adjacent inner and outer air return means in said cabinet for receiving the respective air curtains into the cabinet during refrigerating operations, and the primary air flow during reverse air flow defrosting operations being discharged outwardly from the inner air return means for recapture and return with the downwardly flowing secondary curtain air into the outer air return means of the cabinet.

23. The merchandiser of claim 22, in which said defrost means is adapted to complete a full defrost cycle of said evaporator cooling means in a period of about thirty minutes or less.

24. The merchandiser of claim 1, in which said vertically adjustable shelf means is adjustably supported on a rear panel of the display area in primary air receiving relationship with a distribution duct of the primary air system, and said shelf means including an uninsulated product supporting surface in heat exchange relationship with the air channeling duct means.

25. A refrigerated merchandiser having a cabinet with an open front product display area, primary air system means comprising evaporator means constructed and arranged for refrigerating primary air to maintain a predetermined exit air temperature during refrigerating operations and air moving means for circulating such primary air in a first direction to maintain a substantially uniform target temperature throughout the display area, said primary air circulating means forming a first primary air curtain discharged downwardly across the open front of the display area from the top of the merchandiser cabinet, vertically adjustable shelf means in said display area and having an upper product supporting surface, said shelf means being constructed and arranged with air channeling duct means forming a part of the primary air circulating means and discharging at least one additional curtain of primary air downwardly from the front of the shelf means immediately inwardly of the first primary air curtain at the open front of the display area, the air flow of said primary air curtains being the only positive air movement at said display area, at least one other air system means constructed and arranged for forming a secondary air curtain discharged downwardly across the open front of the display area immediately outwardly of said primary air curtains and returning said secondary air into the cabinet for recycling, and defrost means constructed and arranged for periodically defrosting said evaporator means including means for reversing said air moving means for circulating primary defrost air in a second reverse air flow defrosting direction through the evaporator means while maintaining the normal operation of said other air system means and inducing the return of primary defrost air into the cabinet with the secondary air.

26. A refrigerated food merchandiser having a cabinet with an open front product display area having a plurality of vertically adjustable shelves therein, a primary cold air recycling system constructed and arranged for maintaining substantially constant food product temperatures of about 0° F. or lower in the product area, said primary air system including a primary air passage through the cabinet having a primary air discharge at the upper front of the display area and a primary air return at the lower front of the display area and including the formation of a first primary air curtain downwardly across the open front of the display area between said primary discharge and return openings, said shelves being constructed and arranged with air channeling duct means in communication with the primary air passage to receive refrigerated air therefrom and to form a plurality of other successive primary low temperature air curtains discharged downwardly across discrete display area sections of the open front and on the inward side of the first primary air curtain to the primary return opening, the primary air system having primary air moving means for circulating the primary air in a first refrigerating direction through the primary air passage in the cabinet and the shelf duct means to form said primary air curtains across the open front and to said primary return opening for recycling and discharging primary evaporator means constructed and arranged to cool such primary air in said primary air passage to maintain a predetermined coil exit air temperature of said primary air for providing the substantially constant product temperature in said display area, a secondary non-refrigerated air recycling system having a closed air passage through the cabinet with a secondary air discharge adjacent to the primary air discharge and a secondary air return adjacent to said primary air return, including secondary air moving means for circulating secondary air through said secondary passage and forming a downwardly discharged secondary air curtain across the open front of the cabinet on the outward side of the primary air curtains to said secondary air return, and defrost means associated with said primary air system and constructed and arranged for periodically defrosting said primary evaporator means thereof including means for reversing said primary air moving means for circulating heated primary defrost air in a second reverse air flow defrosting direction through and in heat exchange relation with said evaporator means and thence outwardly through the primary return opening while maintaining the normal operation of said secondary air system including air flow into the adjacent secondary air return to thereby induce the flow of primary defrost air into the secondary air return during defrosting operations.

* * * * *